US010655346B2

(12) United States Patent
White

(10) Patent No.: US 10,655,346 B2
(45) Date of Patent: May 19, 2020

(54) METHOD FOR ERECTING A SHUTTERING FRAMEWORK

(71) Applicant: FAST-FORM SYSTEMS LTD, Grimsby (GB)

(72) Inventor: Tony White, Cleethorpes (GB)

(73) Assignee: FAST-FORM SYSTEMS LTD, Grimsby (GB)

( * ) Notice: Subject to any disclaimer, the term of this patent is extended or adjusted under 35 U.S.C. 154(b) by 191 days.

(21) Appl. No.: 15/508,031

(22) PCT Filed: Oct. 28, 2015

(86) PCT No.: PCT/GB2015/053233

§ 371 (c)(1),
(2) Date: Mar. 1, 2017

(87) PCT Pub. No.: WO2016/110663

PCT Pub. Date: Jul. 14, 2016

(65) Prior Publication Data

US 2017/0292280 A1 Oct. 12, 2017

(30) Foreign Application Priority Data

Jan. 7, 2015 (GB) ..... 1500178.7

(51) Int. Cl.
*E04G 11/08* (2006.01)
*E04G 17/14* (2006.01)
(Continued)

(52) U.S. Cl.
CPC ..... *E04G 11/08* (2013.01); *E04G 11/06* (2013.01); *E04G 17/06* (2013.01); *E04G 17/14* (2013.01);
(Continued)

(58) Field of Classification Search
CPC ..... E04G 11/08
See application file for complete search history.

(56) References Cited

U.S. PATENT DOCUMENTS 3,035,321 A * 5/1962 Hennig ..... E04G 11/12 249/190
3,854,693 A * 12/1974 Kistler ..... E04C 3/08 249/210
4,171,173 A * 10/1979 Hymans ..... E04B 1/215 403/189

FOREIGN PATENT DOCUMENTS

DE 2142150 A1 * 3/1972 ..... E04G 11/12
DE 2142150 A1 3/1972
(Continued)

OTHER PUBLICATIONS

DE2142150, translated. (Year: 1972).*
(Continued)

*Primary Examiner* — Robert A Vetere
(74) *Attorney, Agent, or Firm* — Pepper Hamilton LLP

(57) ABSTRACT

Disclosed herein is a method for erecting a shuttering framework. The method comprises the steps of a) mounting one end of a first support to the ground or other stationary object and mounting one end of a first brace to the ground or other stationary object, b) attaching the opposite end of the first brace to the opposite end of the first support or to a position between the two ends of the first support, c) repeating a) and b) for a second support and a second brace, and d) mounting a plurality of ties between the first and second supports. Also disclosed herein is a method of casting concrete.

18 Claims, 7 Drawing Sheets

(51) Int. Cl.
*E04G 17/16* (2006.01)
*E04G 11/06* (2006.01)
*E04G 17/06* (2006.01)

(52) U.S. Cl.
CPC ..... *E04G 17/16* (2013.01); *E04G 2011/067* (2013.01)

(56) References Cited

FOREIGN PATENT DOCUMENTS

| | | | |
|---|---|---|---|
| FR | 1557938 | A | 2/1969 |
| GB | 696260 | A | 8/1953 |
| WO | 2013/016760 | A1 | 2/2013 |

OTHER PUBLICATIONS

International Search Report and Written Opinion for corresponding Application No. PCT/GB2015/053233 (dated Dec. 23, 2015).

* cited by examiner

METHOD FOR ERECTING A SHUTTERING FRAMEWORK

This application is a national stage application under 35 U.S.C. § 371 of PCT Application No. PCT/GB2015/053233, filed Oct. 28, 2015, which claims the priority benefit of Great Britain Application No. 1500178.7, filed Jan. 7, 2015.

FIELD OF THE INVENTION

The present invention relates to a method for erecting a shuttering framework.

BACKGROUND TO THE INVENTION

Shuttering or formwork used within the construction industry conventionally requires the construction of a bespoke timber framework to which shuttering materials are applied. The timber cannot readily be reused and this system of building is therefore costly, time consuming and wasteful.

More extensive metal shuttering systems are in use, particularly in the construction of high walls, but the systems are supplied as pre-manufactured frames with the shuttering board already attached. This makes them complex to erect and heavy, often requiring the use of cranes or the like. In tight construction areas, such as where headroom is limited, cranes cannot be used, and therefore pre-manufactured metal frameworks are not appropriate. Furthermore, when the frames are joined together for example to make a long wall run, a seam line is present in the shuttering board which means the resultant concrete wall is not perfect.

There has now been developed a method for erecting a shuttering framework, which overcomes or substantially mitigates the above-mentioned and/or other disadvantages associated with the prior art.

SUMMARY OF THE INVENTION

In a first aspect of the invention there is provided a method for erecting a shuttering framework, comprising a) mounting one end of a first support to the ground or other stationary object and mounting one end of a first brace to the ground or other stationary object, b) attaching the opposite end of the first brace to the opposite end of the first support or to a position between the two ends of the first support, c) repeating a) and b) for a second support and a second brace, d) mounting a plurality of ties between the first and second supports.

The method according to the invention is advantageous because it means that a shuttering framework can be erected without the use of a crane. Thus the method is applicable in areas where therein is minimal head room or space and only using minimal tools. It also means that the framework can be erected by hand and quickly. The method also results in a framework which is strong and rigid in both the lateral and vertical directions.

Further supports may be added lengthwise to the framework with the re-suit of extending the overall height of the framework. The user can therefore build a shuttering framework of any height without the use of a crane and using the same components and tools. In the method according to the invention therefore one end of a first extension support may be mounted lengthwise to the opposite end of the first support and one end of a second extension support mounted lengthwise to the opposite end of the second support, and mounting a plurality of ties between the first and second extension supports. The respective supports may be mounted together lengthwise, with a portion of each support overlapping each other. Preferably, the supports are mounted lengthwise using a joining member. The ends of the supports preferably abut one another when mounted together. In this way a flush surface is presented for the mounting of shuttering board to the support.

Further supports and ties may be added on the side of the framework to extend the framework laterally. The user can therefore build a shuttering framework of any length without the use of a crane and using the same components and tools. The method according to the invention therefore preferably comprises mounting one end of an extension support to the ground or other stationary object and mounting one end of an extension brace to the ground or other stationary object, attaching the opposite end of the extension brace to the opposite end of the extension support or to a position between the two ends of the extension support, and mounting a plurality of ties between the extension support and either the first or second support.

The ability to extend the framework upwards and laterally means that the method as described above is modular and the frameworks that result from such a method are also modular. Therefore sections of framework may be added on the sides or the top of the existing framework as required.

The supports may be pivotally mounted to the ground. The supports may be fixed to the ground or other stationary object by anchoring brackets or end plates attached to the ends of the supports. Preferably the respective supports are pivotally mounted to the respective anchoring brackets. This means that the supports may be tilted to displace them angularly from the ground whilst still being fixed to the ground or other stationary object. The anchoring brackets may engage also with the braces, preferably where the braces engage with the ground or other stationary object. For this to happen the anchoring brackets may be a length of channel section metal with one end engaged with the end of the respective braces and the other engaged with the respective supports (as described above).

The attachment of the supports to the anchoring brackets or end plates can be by any conventional fixing such as screws or bolts etc.

For most jobs the supports are preferably arranged vertically. However it will be appreciated that in the method according to the invention the supports could be positioned at any angle with respect to the ground.

In order that the supports can be positioned at any angle with respect to the ground, preferably the one end of each brace is pivotally mounted to the ground and the opposite end is pivotally mounted to the respective support.

The braces may be conventional fixed length bars. Preferably, the braces are adjustable in length. For example, the braces may be telescopic braces. Examples of suitable braces include Acrow® Braces or adjustable shoring props.

The braces may be connected to the supports at a fixed point along the length of the supports (i.e. using a bolt through a hole). In such an embodiment the braces are connected to the supports, and then the angle of the supports altered by adjusting the length of the braces. The braces may be slidingly engaged with the supports. In such an embodiment, the braces preferably engage with a longitudinal slot defined within the supports. This means that the supports can be tilted by sliding the braces within the supports, without altering the length of the braces. It also means that the framework can be quickly constructed and then the angle of the framework to the ground refined by adjusting the length of the braces. The braces may engage with a pair of opposing longitudinal slots present within the side walls of the supports. The connection of the braces to the supports can be by any conventional fixing such as screws or bolts etc.

The ends of the ties are preferably mounted to the supports via brackets or end plates at each end of each tie. The brackets or end plates are preferably arranged at right angles to the tie, and parallel to the support. The end plates or brackets preferably present a flat surface to the support. The end plates or brackets may be bolted to the ends of the ties or welded thereto. The brackets or end plates thereby allow the simple and robust attachment of the ties to the supports. The attachment of the ties to the supports can be by any conventional fixing such as screws or bolts etc.

The ties are preferably mounted perpendicular to the supports in use. Preferably the ties are mounted to the supports within equal spacing between each tie and its neighbour. This means that the supports are tied in the strongest way possible. This also provides a manner of bracing which is the most effective at preventing bowing of the shuttering board when such boarding is attached to the supports. To further aid this, preferably one of the plurality of ties is mounted at the base of framework, between the first and second supports.

The supports may be channel form, box, or angle in cross section. The ties may be channel form, box or angle in cross section. The joining member may be channel form, box or angle in cross section. These types of cross section provide the necessary strength to the framework, so that the framework does not deform under its own weight, and/or the weight of the material behind the shuttering, such as the concrete.

The method according to the invention may further comprise the step of fitting a platform to one or more of the supports. This enables workers to stand at height safely on the framework and position the shuttering board, or attend to any other constructional requirement at height.

The method may further comprise the step of attaching shuttering board against the side of the framework opposite the braces. The attachment of shuttering board means that a surface is created against which a flowable wall material such as concrete can be poured. The combination of the shuttering board and the framework according to the invention has a further advantage in that it means that a conventional kicker pad is not required. A kicker pad is a term used in the art to describe a small pre-set piece of a wall used to align the shuttering for the rest of the wall against. The kicker concrete is poured first and is normally 50 cm (approx.) high with reinforcing tie rods extending upwards from its surfaces. Once it has set it provides a surface for the main concrete of the wall to sit on. The construction of a kicker is time consuming. The method of the present invention does not involve setting a kicker. This is because the bottom part of the framework is fixed to the ground or other stationary object. Thus it cannot move when the concrete is poured. Therefore a wall of any height or length can be constructed without requiring a kicker. Preferably the shuttering board is attached to the framework using fixings which extend from the bracing side of the framework, through the respective supports and/or ties and only partially through the board. In this manner there are no unsightly fixing points exposed on the shuttering board, which would otherwise imprint onto any concrete poured against it.

The method of the invention may be performed as described above in association with the pouring of concrete against the shuttering board. In a second aspect of the invention there is therefore provided a method of casting concrete comprising erecting a shuttering framework according to the method as described above and pouring concrete against the shuttering board.

In the second aspect of the invention the components described are substantially the same as those described in the first aspect. Preferably the concrete is poured against the side of the shuttering board which is opposite the side of the framework on which the braces are attached. In the method according to the second aspect of the invention, the shuttering board and consequently the framework may be arranged as formwork. For example the framework and shuttering may be constructed to present four enclosed sides, like in constructing a concrete columnar structure. Alternatively two frameworks may be arranged opposing one another separated by a gap and concrete poured in the gap.

In the second aspect of the invention the framework and shuttering board may be erected as described above and then further frameworks (and shuttering) minus the braces may be erected and positioned to oppose the existing framework. The two frameworks are separated from each other by a gap. The gap between the two shuttering faces is the gap into which concrete may be poured and which forms a wall (when set). In order to support the further framework, which does not have a brace, preferably rods (such as screw threaded bars) are mounted around each framework. This prevents the further framework from falling away, and is consequently supported by the existing framework. It also means that when the concrete is poured and set there are no channels or rods left in the set wall.

In the method according to the first or second aspect preferably the respective supports are erected between 50 mm and 1500 mm of each other. More preferably the supports are erected between 200 mm and 1200 mm of each other.

In an embodiment of the invention according to the second aspect of the invention, the framework and shuttering board may be erected to create a curved wall. For this to happen the supports are arranged close together and without the braces, and each support is angularly off set from its neighbour. As the supports are close together the braces are not required and the shuttering board has sufficient strength to prevent bowing. Therefore the second aspect of the invention may comprise omitting the step d) of mounting a plurality of ties between the first and second supports and erecting the respective supports between 50 mm and 500 mm of each other, wherein the respective supports are angularly offset from one another.

A preferred embodiment of the invention will now be described in greater detail, by way of illustration, with reference to the accompanying drawings.

DETAILED DESCRIPTION OF THE ILLUSTRATED EMBODIMENT

Figure 1:
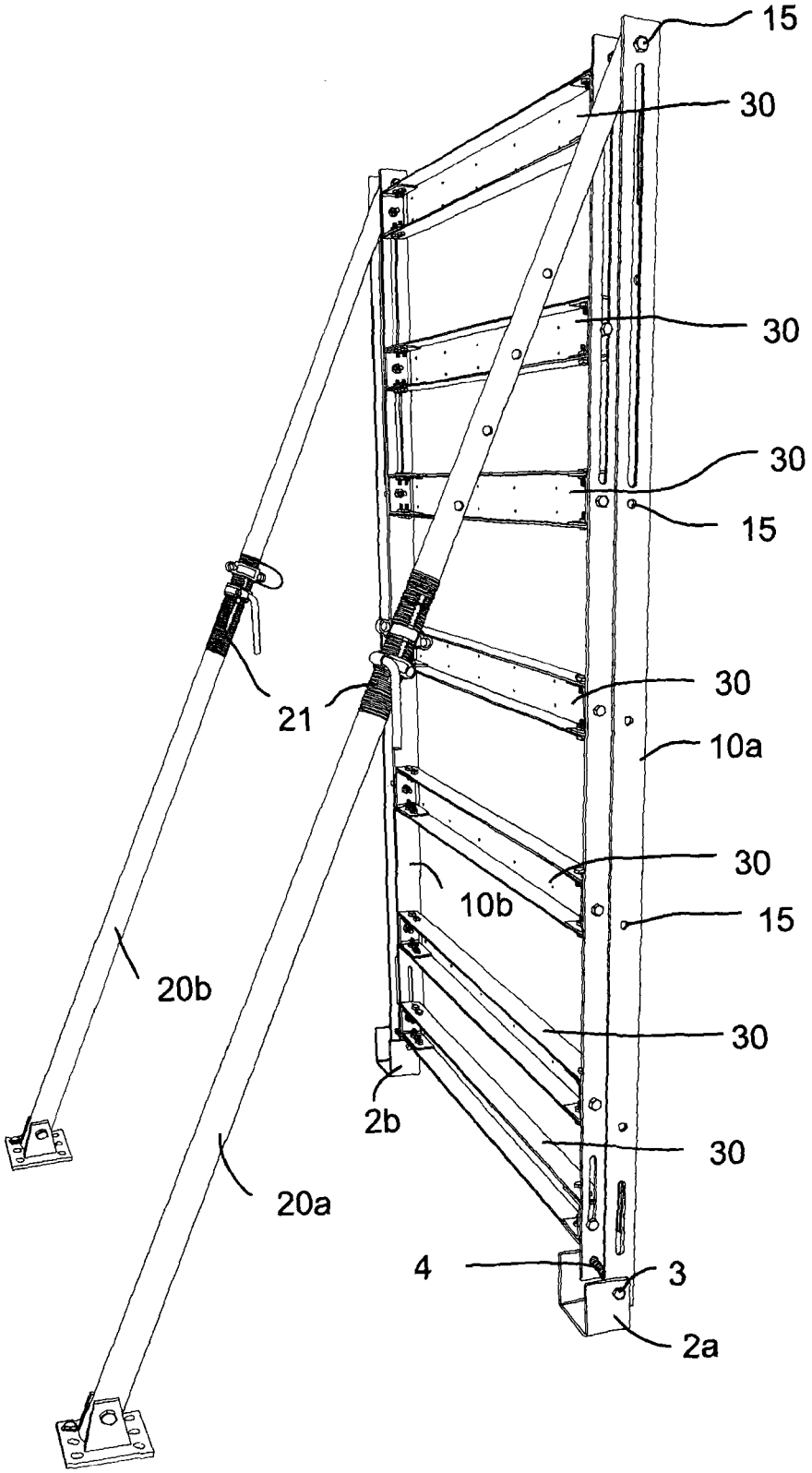
FIG. 1 shows a shuttering framework erected using an embodiment of the method according to the invention.

In FIG. 1 there is shown a shuttering framework erected using an embodiment of the method according to the invention. The framework is generally designated 1. A method for erecting the framework 1 is described as follows.

Figure 2:
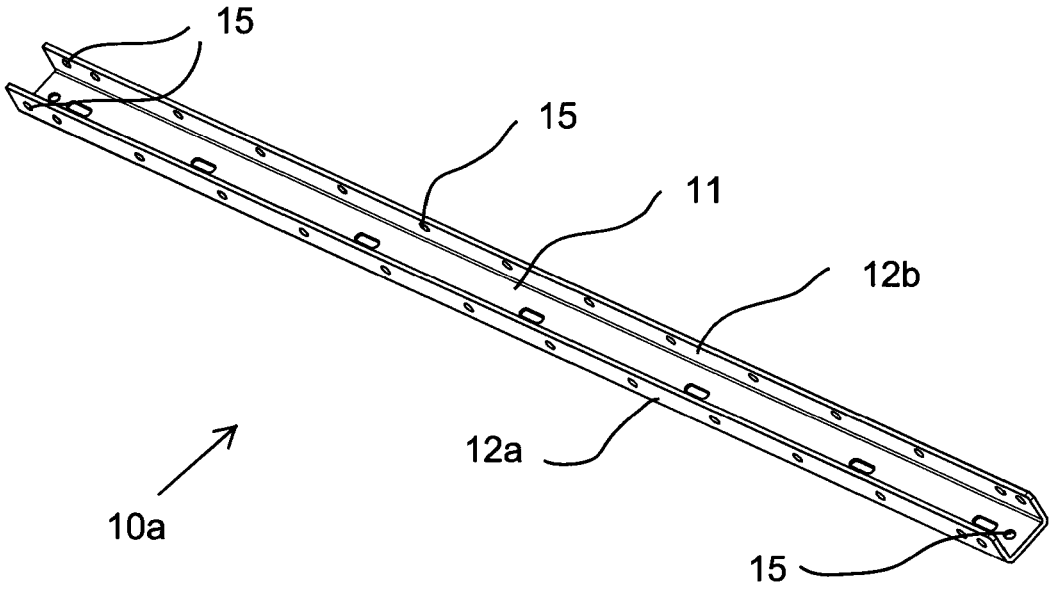
FIG. 2 shows a three dimensional view of an embodiment of a support according to the invention.
Figure 3:
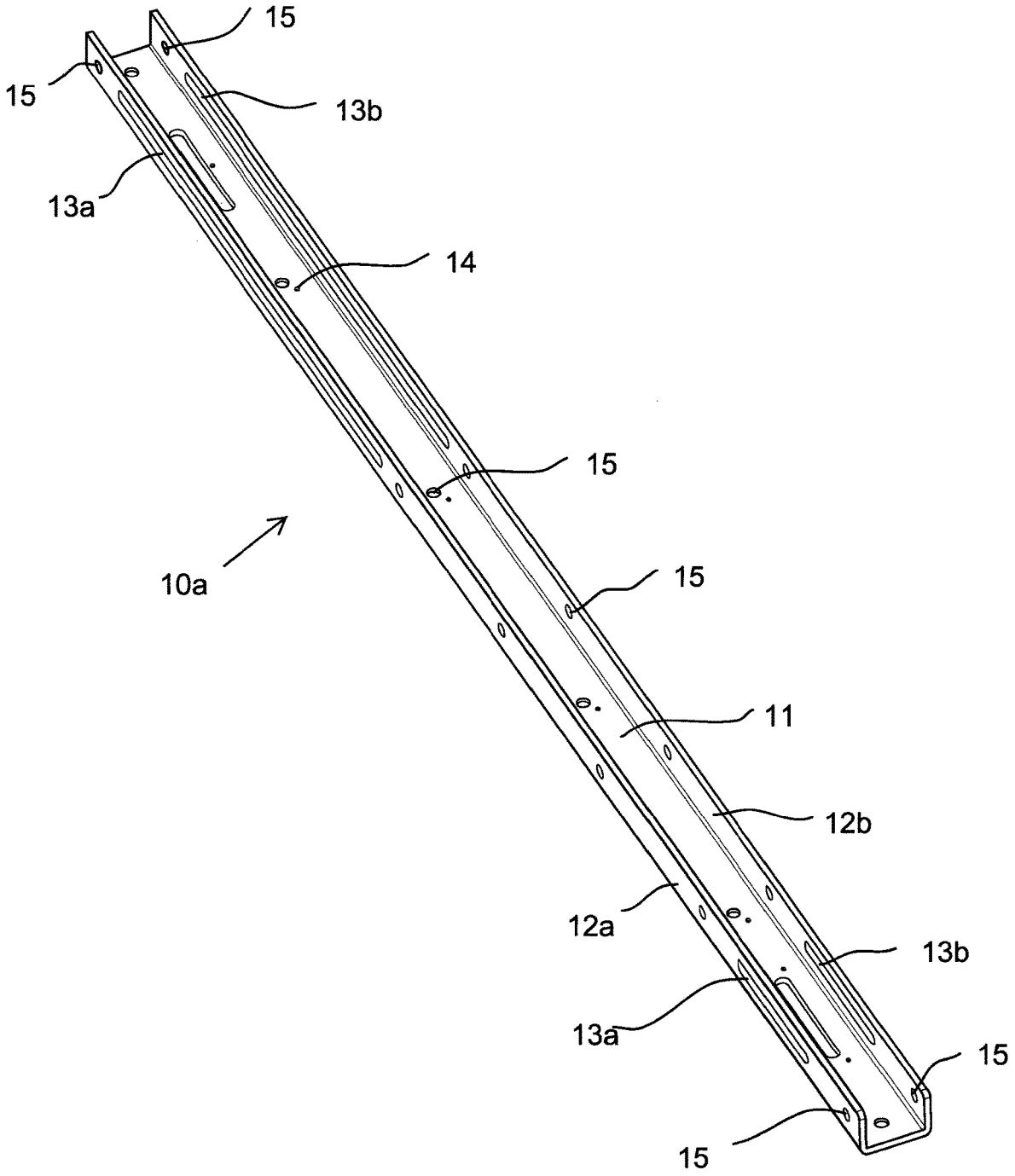
FIG. 3 shows a three dimensional view of a second embodiment of a support according to the invention.

Firstly, one end of a first support 10*a* is fixed to the ground and one end of a first brace 20*a* is fixed to the ground. In the example provided the first support has a pivotal anchoring bracket 2*a* fixed to one of its ends, and it is this bracket that fixes to the ground. The bracket 2*a* is a short length of channel section steel and has a base and two opposing sides. The sides have a hole 3 drilled in them to receive a bolt 4. The base also has a hole drilled in it. A rawl bolt (not shown) is introduced through this hole and is imbedded into the ground surface onto which the bracket 2*a* is placed. The bolt is tightened and this holds the bracket 2*a* and thus the first support 10*a* securely to the ground. In the example shown the first support 10*a* comprises a length of channel section steel. An embodiment of the first support is shown in greater detail in FIG. 2. The first support 10*a* has a shuttering facing side 11 and opposing structural sides 12*a* and 12*b*. Bolt holes 15 are present within the sides 12*a* and 12*b* and in the shuttering facing side 11. The first support 10*a* also has guide holes (not shown) for receiving screws to fix the shuttering board to the side 11. The width of the bracket 2*a* is greater than the width of the first support 10*a* so that the first support 10*a* fits within the bracket 2*a*. It is important that the shuttering facing side 11 is arranged on the side where the shuttering board is to be mounted. One end of a first brace 20*a* is fixed to the ground at a position away from the base of the first support 10*a* and on the non-shuttering side. In the example shown the brace 20*a* is an Acrow® prop that has a hinged base at one end. It is the hinged base that is bolted to the ground using rawl bolts. This means that the brace can still pivot about its ground position but is prevented from moving laterally. The first brace 20*a* has a length adjustment portion 21 and an end 22 opposite the end affixed to the ground. Another example of the first support 10*a* is shown in FIG. 3. I this example, the sides 12*a* and 12*b* have slots in them 13*a* and 13*b*, running parallel with each other. Also the guide holes for receiving retaining screws are shown as 14.

Secondly the end 22 of the brace 20*a* is connected using a bolt fixing to the holes 15 in the top end of the first support 10*a*. This has the effect of bracing the first support in a fixed position. The angle of elevation of the first support to the ground can be altered by adjusting the length of the brace. Alternatively the brace may be bolted into the slots 13*a* and 13*b* (see FIG. 3). In such an embodiment the brace slidingly engage with the supports and are then fixed using bolts. This means that the framework can be quickly erected and then the supports brought into true (or to the angle required) by adjusting the length of the brace.

The steps above are repeated for a second support 10*b* and second brace 20*b*. All components are substantially the same as described above. The second bracket 2*b* is substantially the same as the first bracket 2*a* as described above and is fixed to the ground in substantially the same manner as above, as is the second brace.

Figure 4:
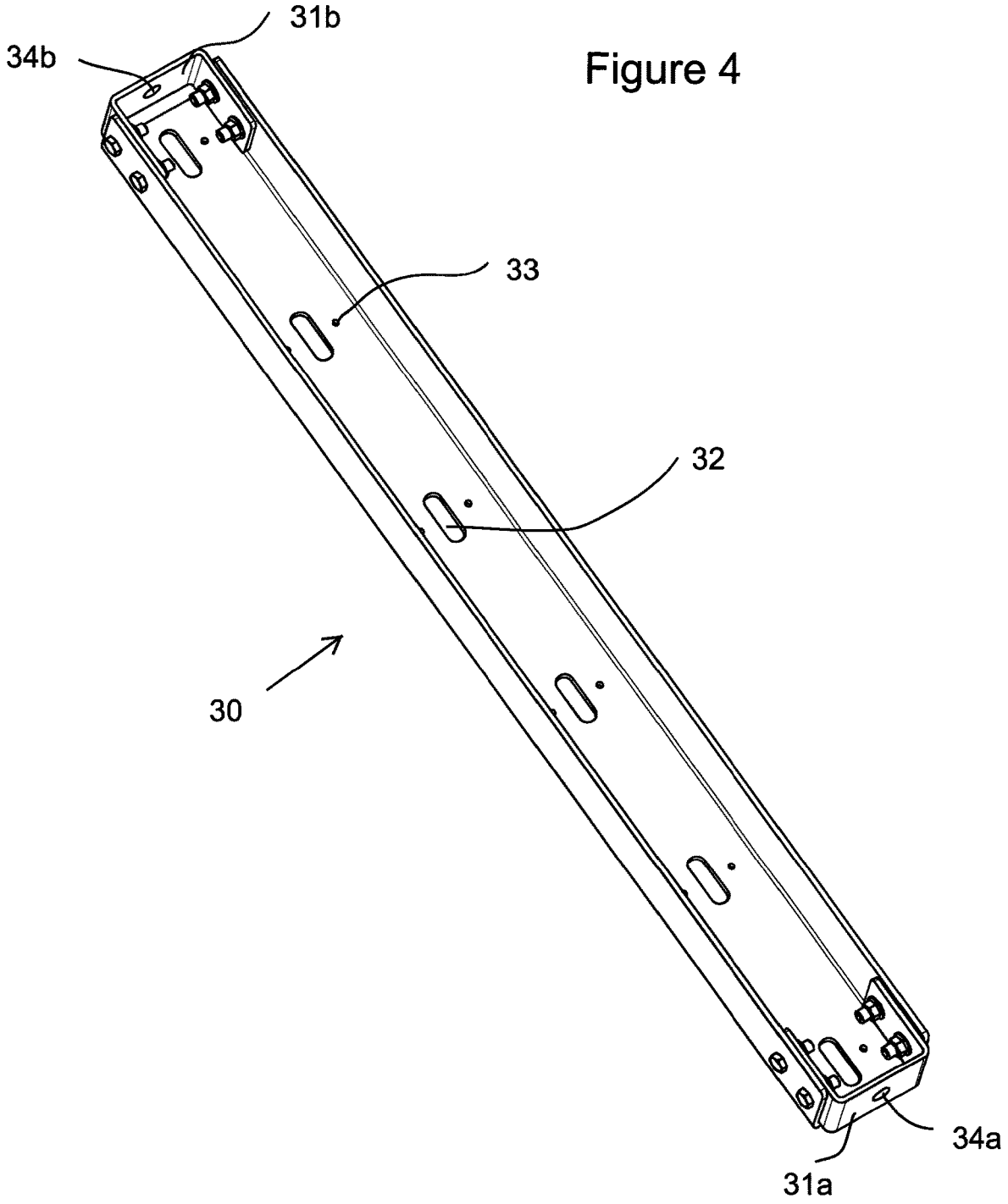
FIG. 4 shows a three dimensional view of an embodiment of a tie and bracket according to the invention.

Lastly, a plurality of ties 30 are mounted between the first and second supports 10*a* and 10*b*. The ties 30 are each channel shape metal and have an end plate 31*a* and 31*b* attached to each end. Detail of each tie is shown in FIG. 4. The ties 30 have bolt holes 32 and guide holes 33 along their length. The end plates 31*a* and 31*b* have a central bolt hole 34*a* and 34*b*. These are aligned with bolt holes in the first and second support and secured using bolts (see FIG. 6 bolts 100). The ties 30 run at right angles to the supports. The base of the channel section faces the side when the shuttering board is to be attached.

Shuttering board is attached to the front of the framework 1, which is the side not having the braces 20*a* 20*b* etc. The board (plywood for example) is attached using screw fixings which are introduced from the bracing side of the framework and bond the board to the framework 1 without protruding through to the wall side. In such a way, when the wall is created, there are no seam marks, joins or unsightly holes etc.

Figure 5:
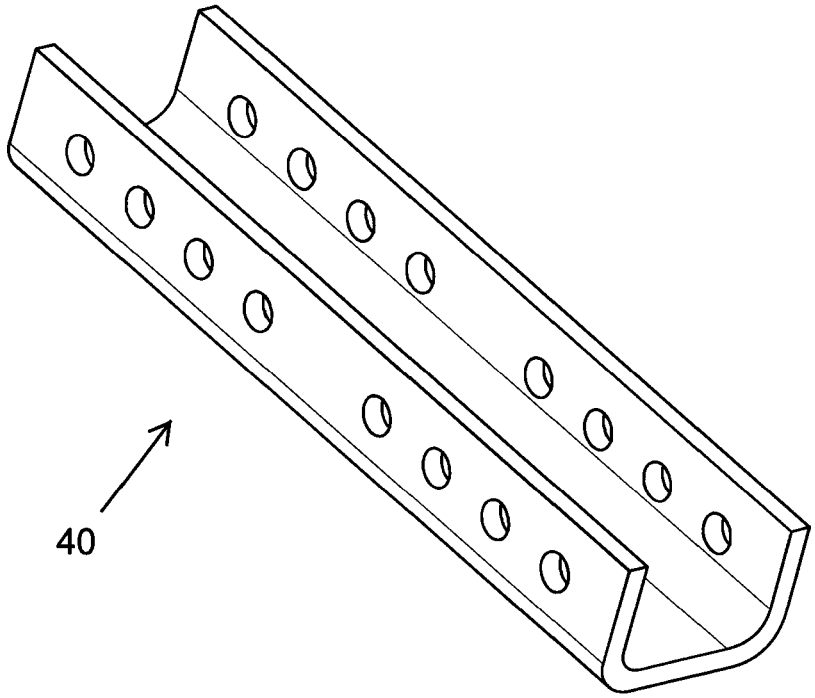
FIG. 5 shows a three dimensional view of an embodiment of a joining member according to the invention.

The framework 1 may be extended upwardly by joining on lengthwise extension supports to the ends of the existing supports of the erected framework. These extension supports are tied together with ties as described above. It is intended that this process could be repeated as required with supports being joined lengthwise end on end to create tall frameworks of any height. For this a joining member 40 is used to join (lengthwise) two supports together. The joining member (shown in FIG. 5) is a section of channel section steel and fits lengthwise inside the channel section of the two supports, which are arranged to abut one another at their ends. Bolts are engaged through the side walls of each channel section so that no bolts protrude through to the shuttering side of the framework (ie non brace side).

Figure 6:
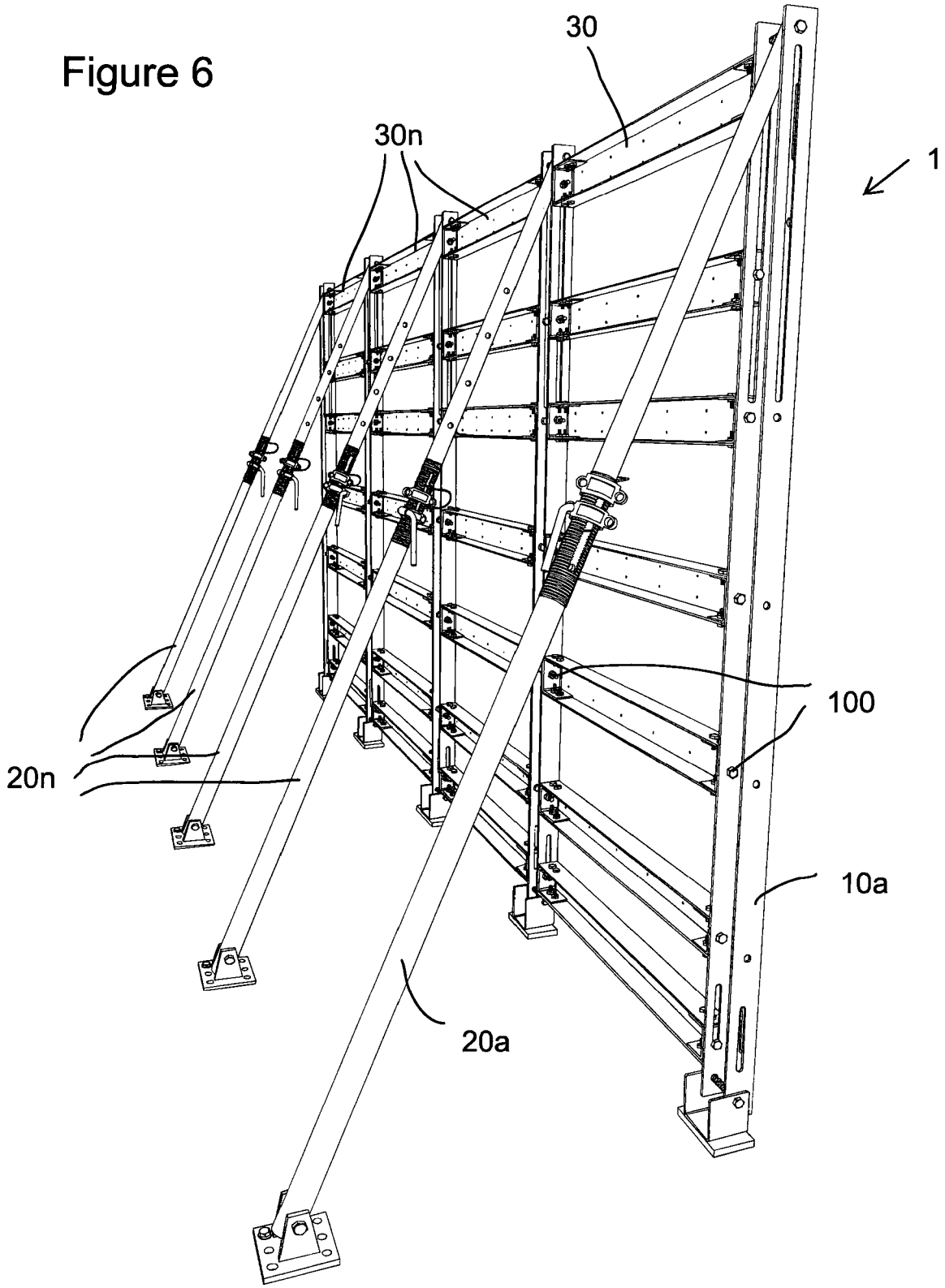
FIG. 6 shows a shuttering framework erected using an embodiment of the method according to the invention, wherein the framework has been extended laterally.

The framework 1 may be extended laterally by erecting further supports (according to the steps above) and mounting between them and the existing framework a further set of ties. It is intended that this process could be repeated as required. Such a laterally extended structure is shown in FIG. 6. In FIG. 6 the lateral extension is represented by the addition of further supports 10*n* and braces 20*n* and ties 30*n* assembled as described above.

Plywood shuttering board is attached against the side of the framework opposite the braces. Other types of boarding are suitable such as fibre board or plastic sheet. The shuttering board is attached to the framework from the side of the framework where the braces are positioned. That is to say, screws are introduced from the bracing side of the framework through the holes 14 and 33 and into the board. The length of the fixings is less than the thickness of the board and the metal part of the framework combined. Therefore the fixings do not protrude through to the opposite side of the framework.

Figure 7:
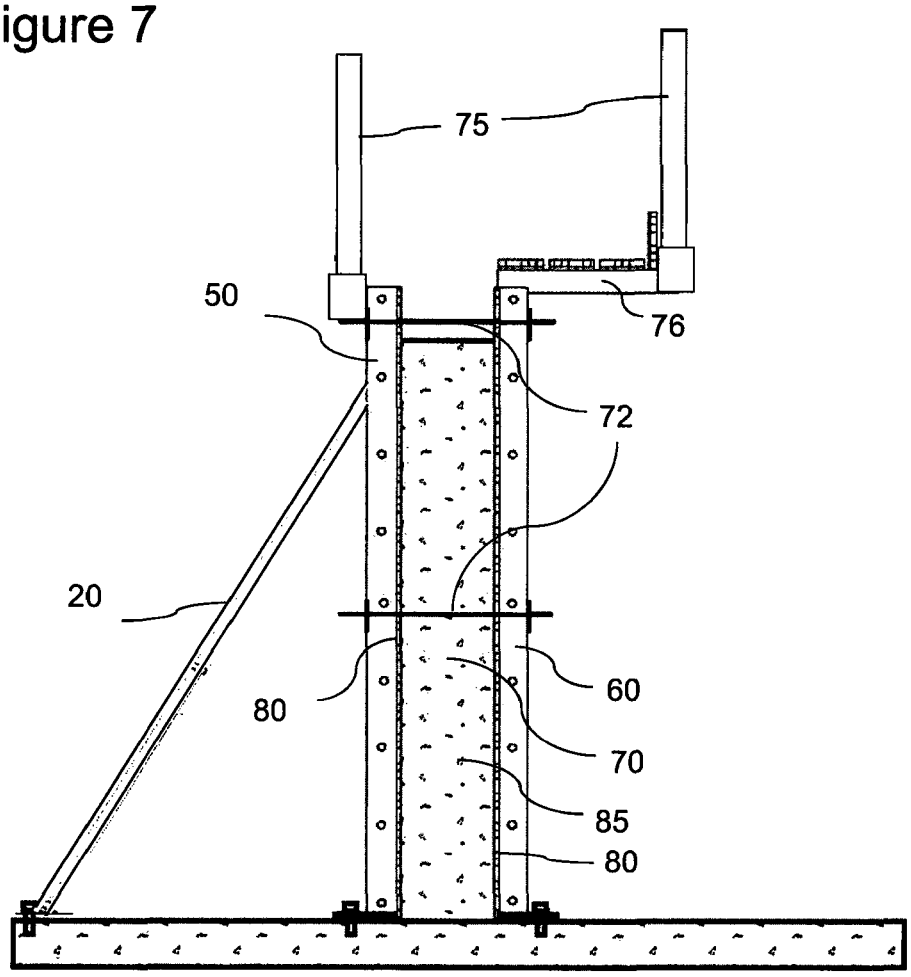
FIG. 7 shows a cross sectional view through a shuttering framework constructed according to an embodiment of the second aspect of the invention.

In one example of the invention a concrete wall is created as shown in FIG. 7. A first framework 50 is erected. Then a second framework 60 minus the bracings is erected to oppose the framework 50. The two frameworks 50 and 60 are separated by a gap 70. Metal tie screw rods 72 are mounted between the two frameworks, at the extremity of the frameworks (ie around the structure) and are secured with nuts to hold the two frameworks in position. The metal rods 72 extend around the frameworks 50 and 60 (ie to the side and/or above) and therefore do not go through the gap 70. This is a benefit of the invention, in that supporting ties or rods are not required to go through the gap 70 which means that when the concrete is poured and set there are no channels or rods left in the concrete wall. In the example shown in FIG. 7, the brace 20 supports the first framework 50 and the second framework 60 is supported by the rods 72 which are attached to the first framework 50. Hand rails 75 and platforms 76 are added to the top of the frameworks. Plywood shuttering board 80 is attached as described above and as shown in the figures to face inwardly. Concrete 85 is poured in the gap 70. No kicker is required. The concrete is left to set and then the frameworks are removed leaving a cast wall. The concrete can have conventional reinforcing rods implanted therein.

The invention claimed is:

1. A method for erecting a shuttering framework, comprising:

mounting one end of a first support to the ground or other stationary object and mounting one end of a first brace to the ground or other stationary object;

attaching the opposite end of the first brace to the opposite end of the first support or to a position between the two ends of the first support after the mounting of the one end of the first support and the one end of the first brace to the ground or other stationary object;

repeating the mounting and the attaching steps for a second support and a second brace;

mounting a plurality of ties between the first and second support, wherein the ends of the plurality of ties are joined to the first support and the second support via brackets or end plates at each end of each of the plurality of ties;

mounting one end of a first extension support to the opposite end of the first support, wherein the one end of the first extension support abuts the opposite end of the first support and the first extension support extends lengthwise from the first support when mounted;

mounting one end of a second extension support to the opposite end of the second support, wherein the one end of the second extension support abuts the opposite end of the second support and the second extension support extends lengthwise from the second support when mounted; and mounting another plurality of ties between the first and second extension supports.

2. The method according to claim 1 further comprising:

mounting one end of an extension support to the ground or other stationary object and mounting one end of an extension brace to the ground or other stationary object;

attaching the opposite end of the extension brace to the opposite end of the extension support or to a position between the two ends of the extension support; and mounting another plurality of ties between the extension support and either the first or second support.

3. The method according to claim 1, wherein the first support and the second support are fixed to the ground or other stationary object by anchoring brackets attached to the ends of the first support and the second support.

4. The method according to claim 3, wherein the respective supports are pivotally mounted to the respective anchoring brackets.

5. The method according to claim 1, wherein the one end of each of the first brace and the second brace is pivotally mounted to the ground and the opposite end is pivotally mounted to the respective support.

6. The method according to claim 1, wherein the first brace and the second brace are adjustable in length.

7. The method according to claim 1, wherein the first brace and the second brace are slidingly engaged with the support.

8. The method according to claim 1, wherein the first extension support and the second extension support are joined to the first support and the second support, respectively, using a joining member.

9. The method according to claim 8, wherein the joining member is channel form, box, or angle in cross section.

10. The method according to claim 1, wherein the plurality of ties are mounted perpendicular to the first support and the second support in use.

11. The method according to claim 1, wherein the first support and the second support are channel form, box, or angle in cross section.

12. The method according to claim 1, wherein the plurality ties are channel form, box, or angle in cross section.

13. The method according to claim 1, further comprising fitting a platform to one or more of the first support and the second support.

14. The method according to claim 1, further comprising attaching shuttering board against the side of the shuttering framework opposite the first brace and the second brace.

15. A method of casting concrete comprising:

erecting the shuttering framework according to the method as claimed in claim 14; and pouring concrete against the shuttering board.

16. The method according to claim 15, further comprising:

erecting a further shuttering framework according to the method as claimed in claim 14 to oppose the shuttering framework, the shuttering framework and the further shuttering framework being separated from each other by a gap, wherein the further shuttering framework is supported by tie rods mounted between the shuttering framework and the further shuttering framework.

17. A method for erecting a shuttering framework, the method comprising:

mounting one end of a first support to the ground or other stationary object and mounting one end of a first brace to the ground or other stationary object;

attaching the opposite end of the first brace to the opposite end of the first support or to a position between the two ends of the first support;

repeating the mounting and the attaching for a second support and a second brace to form the shuttering framework, wherein the first support and the second support are erected between 50 mm and 500 mm of each other and are angularly offset from one another;

mounting one end of a first extension support to the opposite end of the first support, wherein the one end of the first extension support abuts the opposite end of the first support and the first extension support extends lengthwise from the first support when mounted;

mounting one end of a second extension support to the opposite end of the second support, wherein the one end of the second extension support abuts the opposite end of the second support and the second extension support extends lengthwise from the second support when mounted; and mounting another plurality of ties between the first and second extension supports.

18. A method of casting concrete comprising;

erecting the shuttering framework according to the method as claimed in claim 17;

attaching shuttering board against the side of the shuttering framework opposite the first brace and the second brace; and pouring concrete against the shuttering board.

* * * * *